US005327596A

United States Patent [19]

Wallace et al.

[11] Patent Number: 5,327,596

[45] Date of Patent: Jul. 12, 1994

[54] COMBINATION SPRING/FOAM CUSHIONING

[75] Inventors: William R. Wallace, Hickory; James N. Finley, Lenoir, both of N.C.

[73] Assignee: Hickory Springs Manufacturing Company, Hickory, N.C.

[21] Appl. No.: 99,061

[22] Filed: Jul. 29, 1993

[51] Int. Cl.[5] ..... A47C 27/20; A47C 27/05

[52] U.S. Cl. ..... 5/475; 5/481

[58] Field of Search ..... 5/481, 475, 481, 653

[56] References Cited

U.S. PATENT DOCUMENTS 3,401,411 9/1968 Morrison ..... 5/481
4,429,427 2/1984 Sklar ..... 5/481

FOREIGN PATENT DOCUMENTS 0635502 4/1983 Switzerland ..... 5/481
760958 11/1956 United Kingdom ..... 5/475

OTHER PUBLICATIONS

Alexander Furniture Supply advertisement re Spring Wrapture Custom-Crafted Cushion, Jul. 1989.

*Primary Examiner*—Alexander Grosz
*Attorney, Agent, or Firm*—Shefte, Pinckney & Sawyer

[57] ABSTRACT

An improved spring/foam cushion is formed of an assembly of an integral foam body sandwiched between two foam caps, and imbedded with individual spring units.

3 Claims, 3 Drawing Sheets

COMBINATION SPRING/FOAM CUSHIONING

BACKGROUND OF THE INVENTION

The present invention relates generally to a cushioning assembly comprised of a foam body with individual spring units imbedded within it.

Conventional cushions made from a combination of wire springs and resilient foam, such as are commonly utilized in seat cushions and the like, are typically fabricated by encasing an assembly of individually pocketed and interconnected coil springs in resilient polyurethane foam and then wrapping the foam in either polyester fiber batting or in a plush down wrapping. In particular, the coil springs are normally cylindrical in shape and connected together, either by a system of connecting clips or continuous wire, and foam pieces are glued together to form an outer envelope around the springs. In some spring/foam cushioning assemblies, each spring may be enclosed within an individual nonwoven sock for additional sound dampening of contact between the springs.

Spring/foam cushioning assemblies are desirable because of their ability to integrate the soft cushioning of foam with the resilient support of springs. Use of foam with sufficient compressibility to provide comfortable cushioning, alone, would not provide sufficient support to maintain the foam's integrity against the cushioned body. Hence, spring units are employed to generate a restoring force against the cushioned body once the foam has been compressed a certain amount, thereby supplying support of the cushioned body. Use of springs units alone, on the other hand, is not desirable because of the inability of springs to absorb and retain an impacting force, i.e., foam provides a dampening effect because of its ability to compress and remain compressed. Alternatively, while not exhibiting undue oscillation, use of springs with high spring constants would feel hard and firm, and generally would not be thought of as comfortable.

Spring/foam cushioning assemblies are also desirable because of their ability to maintain their shape after many years of use.

SUMMARY OF THE INVENTION

It is accordingly an object of the present invention to provide an improved spring/foam cushioning assembly which can be manufactured at a cheaper cost than conventional spring/foam cushions.

It furthermore is an object of the present invention to provide a greater range of integration of the cushioning characteristic of foam with the resilient support of springs.

Briefly summarized, the present invention is comprised of a resilient foam body having opposed outer surfaces with the outer surfaces defining a foam thickness. Individual resilient spring units are imbedded independent of and at spacings to one another within the foam body so that the direction of compression and expansion of each spring unit is in the direction of the foam thickness. It is contemplated that cavities may be formed in the foam body in which the spring units may be inserted. However, it is also contemplated that the spring units may be inserted without first forming cavities, possibly either by screwing the spring units into the foam body, or forming the foam body about the spring units.

In a preferred embodiment of the invention, cavities are formed of cylindrical shape and extend from one surface of the foam body and to the opposing other surface. Into each of these cavities is inserted a coil spring unit having at least one helical coil of an axial length equal to the foam thickness and of a diameter equal to the diameter of the cylindrical cavity. On the ends of each spring is attached a coil of greater diameter than the diameter of the cylindrical cavity so as to secure the at least one helical spring in the cavity by overlying the opposing outer surfaces of the foam body. After insertion of the spring units, a foam cap is then attached to the outer surfaces of the foam body, and then the resulting cushion is wrapped in a fiber batting material and inserted into a cloth cover.

DESCRIPTION OF THE PREFERRED EMBODIMENT

Figure 1:
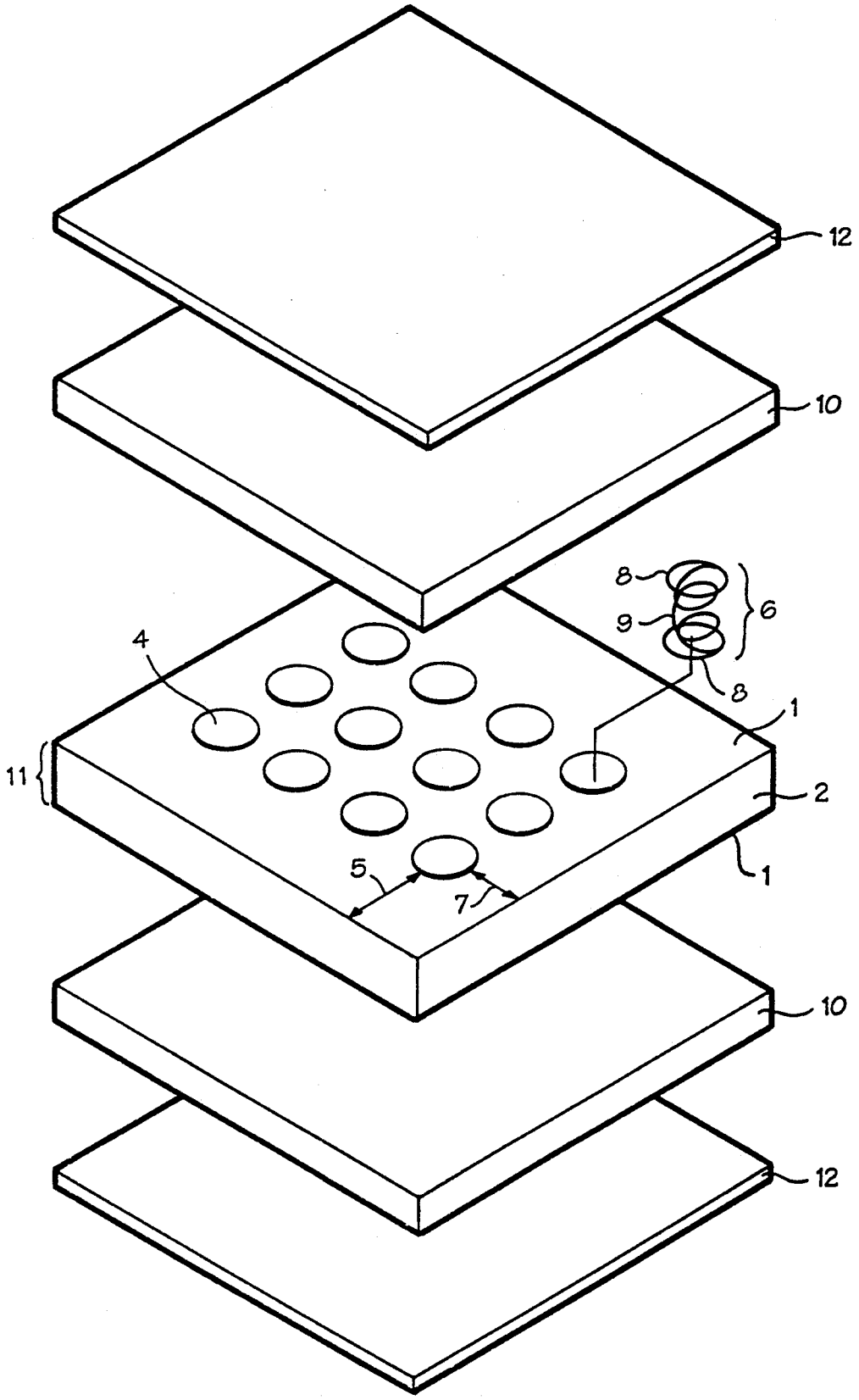
FIG. 1 is an exploded perspective view of the preferred embodiment of the present invention.
Figure 2:
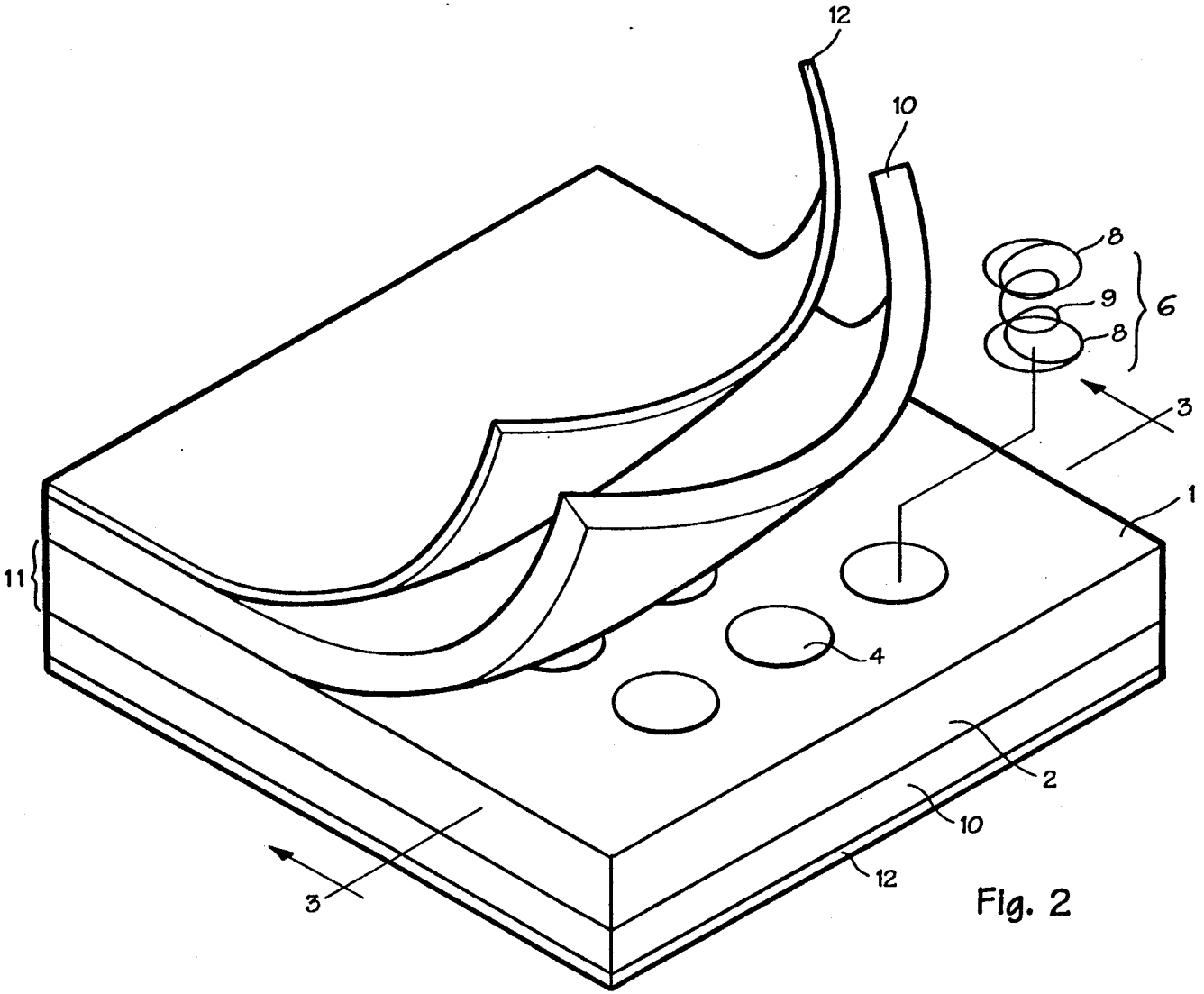
FIG. 2 is an assembled perspective view of the preferred embodiment with the outer foam cap and fiber batting layers shown peeled back for better illustration of the foam body and coil springs.
Figure 3:
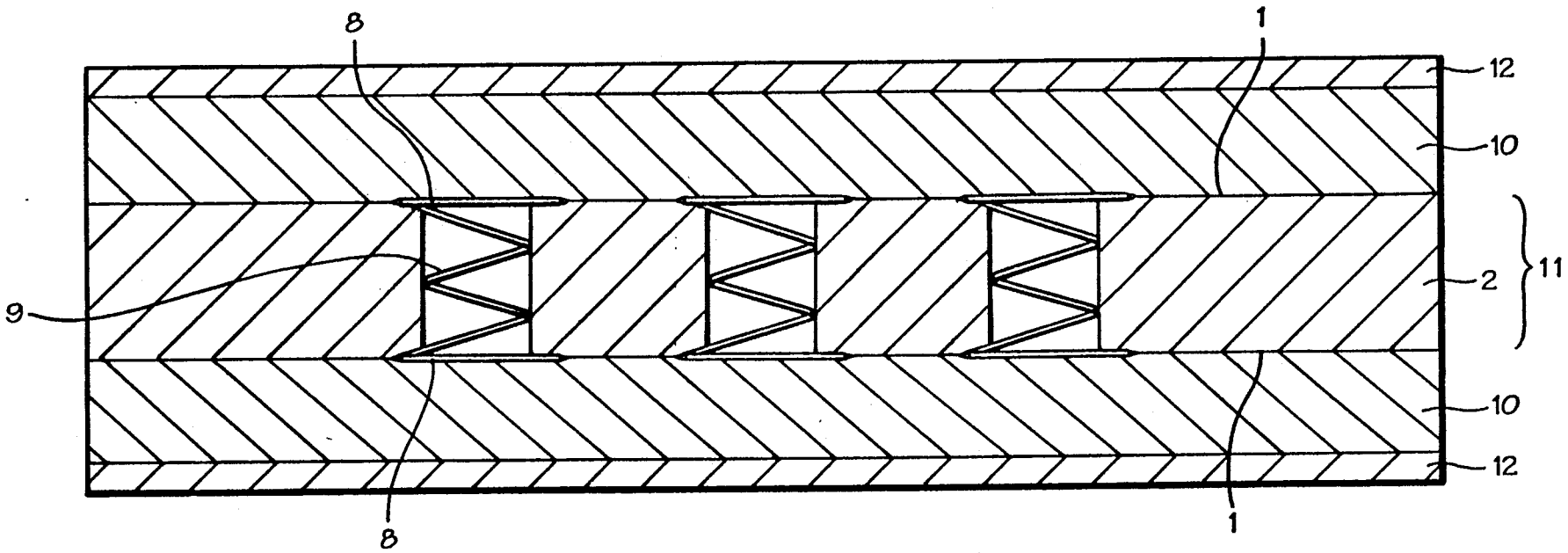
FIG. 3 is a cross-sectional view taken along line 3—3 of FIG. 2.

Referring now to the accompanying drawings, the preferred embodiment of the present invention is constructed by drilling or otherwise cutting cylindrical cavities 4 through a unitary foam body 2 of a rectangularly parallelipped shape having opposed parallel outer faces 1 defining therebetween a predetermined foam thickness 11. The cavities 4 are drilled in a desired predetermined matrix formation, e.g. a rectangular arrangement of perpendicularly intersecting linear columns and rows, the spacings of the cavities and the outer dimensions of the overall matrix being substantially selected to occupy the entire facial dimension of the foam body with predetermined certain margins 5, 7 extending from the edges of the foam body to the edges of the matrix.

Inserted into each cavity 4 is a coil spring unit 6 having one or more helical cylindrical coils 9 connected at their opposite ends to radially oriented circular end coils 8 of a greater diameter than the helical coils 9.

The respective dimensions of the foam body 2 and the coil spring units 6 are selected in relation to one another to insure securement of the spring units 6 within the foam cavities 4. Specifically, the axial dimensions of the springs 9 and the foam thickness 11 are substantially the same and the diameters of the helical coils 9 and of the cylindrical cavities 4 are likewise approximately equivalent. In turn, the diameter of the end coils 8 of the spring units 6 are substantially greater than that of the helical coils 9 and cavities 4.

The foam body 2 and the spring units 6 are assembled with one another by manually pushing and simultaneously twisting each coil spring unit 6 one by one axially through a respective one of the cavities 4, the leading end coil 8 of each spring 9 expanding the foam wall of its cavity 4 until the end coil 8 emerges from the opposite end of the cavity 4, whereupon the spring unit 6 is seated securely in its cavity 4 with the end coils 8 overlying the opposite outer surfaces 1 surrounding the respective cavity 4 to secure the spring unit 6 in embedded relation within the foam body 2. A foam cap 10 is then glued to the outer opposed surfaces 1 of the foam body 2, and a fibrous batt 12 is then attached to the each foam cap 10.

Due to the construction of the present invention, which entails insertion of single spring units independent of one another, the present invention is manufactured at a lower cost than conventional cushioning assemblies.

Furthermore, the present invention retains its shape during many years of use. Experiments designed to test the distortion of the springs over a time period of six years revealed that the springs remained exactly the same in length. Two cushion assemblies of the present invention were tested under 200 lbs. pressure at 20,000 cycles. This would be equivalent to approximately six years of normal wear. Test results showed no appearance of general wear, nor evidence of compression set in the foam, and no distortion nor diminished loft in the springs. The springs measured exactly the same both before and after testing.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A cushioning assembly for seats and the like, comprising:

a foam body having opposed outer surfaces defining a foam thickness therebetween, said foam body being compressibly resilient in the direction of its said foam thickness, said foam body including a plurality of cavities extending in the direction of said foam thickness, each said cavity opening at opposite ends thereof to said opposed outer surfaces of said foam body; and a plurality of compressibly resilient coil spring units, each said spring unit having at least one helical coil and a pair of end coils affixed to opposite ends of said at least one helical coil, said end coils comprising securing portions, said spring units being contained in said cavities to be imbedded independently of and at spacings from one another within said foam body with each said spring unit oriented for compression in the direction of said foam thickness and with each said securing portion of each said spring unit overlying a respective one of said outer surfaces of said foam body, whereby said foam body and said spring units cooperate to provide resilient cushioning and support in the direction of said foam thickness.

2. A cushioning assembly according to claim 1, wherein said cavities comprise cylindrical openings extending between said outer surfaces of said foam body, said at least one helical coil of each said coil spring having a diameter approximately corresponding to the diameter of said openings and an axial dimension corresponding to said foam thickness, and said end coils of each said coil spring having a greater diameter than the diameter of said openings.

3. A cushioning assembly according to claim 1, further comprising at least one layer of foam attached to at least one of said outer surfaces of said foam body.

* * * * *